US011007397B2

(12) United States Patent
Liu

(10) Patent No.: US 11,007,397 B2
(45) Date of Patent: May 18, 2021

(54) ADJUSTABLE DUMBBELL

(71) Applicant: OHFG TECHNOLOGIES(SHANGHAI) CO., LTD, Shanghai (CN)

(72) Inventor: Ping Liu, Shanghai (CN)

( * ) Notice: Subject to any disclaimer, the term of this patent is extended or adjusted under 35 U.S.C. 154(b) by 39 days.

(21) Appl. No.: 16/440,038

(22) Filed: Jun. 13, 2019

(65) Prior Publication Data

US 2020/0330813 A1 Oct. 22, 2020

(30) Foreign Application Priority Data

Apr. 18, 2019 (CN) ..... 201920529575.0

(51) Int. Cl.
*A63B 21/075* (2006.01)
*A63B 21/072* (2006.01)

(52) U.S. Cl.
CPC ..... *A63B 21/075* (2013.01); *A63B 21/0726* (2013.01); *A63B 21/0728* (2013.01)

(58) Field of Classification Search
CPC ..... A63B 21/0004; A63B 21/00058; A63B 21/00061; A63B 21/00065; A63B 21/00069; A63B 21/00076; A63B 21/062; A63B 21/0624; A63B 21/072; A63B 21/0726; A63B 21/0728; A63B 21/075; A63B 21/4023; A63B 21/4027; A63B 21/4035; A63B 21/4043; A63B 21/4045; A63B 21/4047; A63B 21/4049; A63B 2244/09
See application file for complete search history.

(56) References Cited

U.S. PATENT DOCUMENTS 4,529,197 A * 7/1985 Gogarty ..... A63B 21/0728 482/107
4,638,994 A * 1/1987 Gogarty ..... A63B 21/0728 482/107
5,839,997 A * 11/1998 Roth ..... A63B 21/0728 482/107
6,142,918 A * 11/2000 Liu ..... A63B 21/072 16/430
6,500,101 B1 * 12/2002 Chen ..... A63B 21/0728 482/107
7,048,678 B2 * 5/2006 Harms ..... A63B 21/0728 482/107
7,128,696 B1 * 10/2006 Krull ..... A63B 21/0728 482/107
7,285,078 B1 * 10/2007 Liu ..... A63B 21/0728 482/106

(Continued)

*Primary Examiner* — Gary D Urbiel Goldner
(74) *Attorney, Agent, or Firm* — W&K IP

(57) ABSTRACT

This utility model relates to the field of dumbbells and, in particular, to an adjustable dumbbell comprising knobs, bridge-shaped blocks, weight plates, a lift assembly, side plates, an anti-slip assembly and sleeves. The number of the weight plates is two, and they are fixedly attached to the opposing ends of the lift assembly. The bridge-shaped blocks and the weight plates are fixedly disposed between the lift assembly and the knobs. Separation of sockets from inserting plates concurs with extraction of a securing bar from a second through hole and from a first through hole. The handle may be then pulled to a desired position by virtue of the movement of locking blocks in respective locking grooves.

7 Claims, 10 Drawing Sheets

(56) References Cited

U.S. PATENT DOCUMENTS 7,452,312 B2 * 11/2008 Liu ..... A63B 21/0728 482/106
7,491,155 B2 * 2/2009 Fenelon ..... A63B 21/0601 482/107
7,604,578 B2 * 10/2009 Liu ..... A63B 21/075 482/106
8,007,415 B1 * 8/2011 Lundquist ..... A63B 21/0728 482/107
9,504,868 B2 * 11/2016 Liu ..... A63B 21/075
10,335,628 B1 * 7/2019 Scarpa ..... A63B 21/0618
2002/0107118 A1 * 8/2002 Shifferaw ..... A63B 21/0728 482/106
2003/0144117 A1 * 7/2003 Krull ..... A63B 21/0728 482/106
2005/0277525 A1 * 12/2005 Liu ..... A63B 21/075 482/107
2006/0189458 A1 * 8/2006 Walkerdine ..... A63B 71/0036 482/106
2007/0184945 A1 * 8/2007 Lin ..... A63B 21/075 482/107
2007/0254785 A1 * 11/2007 Lin ..... A63B 21/075 482/108
2008/0070761 A1 * 3/2008 Lin ..... A63B 21/0728 482/107
2009/0118105 A1 * 5/2009 Schiff ..... A63B 21/075 482/107
2009/0186748 A1 * 7/2009 Golesh ..... A63B 21/0728 482/107
2009/0197745 A1 * 8/2009 Olson ..... A63B 21/0728 482/107
2011/0021327 A1 * 1/2011 Lien ..... A63B 21/0728 482/107
2013/0231224 A1 * 9/2013 Svenberg ..... A63B 21/0724 482/107
2015/0360073 A1 * 12/2015 Moran ..... A63B 21/075 482/107
2015/0367163 A1 * 12/2015 Moran ..... A63B 71/0619 482/108
2016/0089560 A1 * 3/2016 Smith ..... A63B 21/075 482/108
2016/0089575 A1 * 3/2016 Smith ..... A63B 21/0726 482/5
2016/0166873 A1 * 6/2016 Liu ..... A63B 21/0726 482/107
2017/0001061 A1 * 1/2017 Marjama ..... A63B 71/0619
2017/0072243 A1 * 3/2017 Chen ..... A63B 21/0726
2017/0072248 A1 * 3/2017 Chen ..... A63B 21/0728
2017/0239510 A1 * 8/2017 Wang ..... A63B 21/0726
2018/0078810 A1 * 3/2018 Chen ..... A63B 21/075
2018/0078811 A1 * 3/2018 Chen ..... A63B 21/0726
2018/0117386 A1 * 5/2018 Wang ..... A63B 21/4043
2018/0169459 A1 * 6/2018 Wang ..... A63B 71/0619
2018/0264308 A1 * 9/2018 Wang ..... A63B 21/075
2018/0353794 A1 * 12/2018 Wang ..... A63B 21/075
2019/0299047 A1 * 10/2019 Nalley ..... A63B 21/0728
2019/0366142 A1 * 12/2019 Dale ..... A63B 15/00
2019/0388723 A1 * 12/2019 Nalley ..... A63B 21/0058
2020/0197740 A1 * 6/2020 Liu ..... A63B 21/0603

* cited by examiner

ADJUSTABLE DUMBBELL

CROSS-REFERENCE TO RELATED APPLICATIONS

This application claims priority to Chinese Patent Application No. 201920529575.0 with a filing date of Apr. 18, 2019. The content of the aforementioned application, including any intervening amendments thereto, are incorporated herein by reference.

TECHNICAL FIELD

This utility model relates to the field of dumbbells and, in particular, to an adjustable dumbbell.

BACKGROUND

Dumbbells gain their name because they do not make any noise when used as auxiliary equipment for exercises for weightlifting and fitness. They are smaller than barbells and allow weight adjustments by users during training. For example, Patent No. CN200820075250.1 discloses an adjustable dumbbell which allows a user to rotate knobs to adjust its weight to be lifted, thus accomplishing weight adjustments. However, an actuating handle of the dumbbell has a fixed length that cannot be changed or adjusted according to actual needs. In addition, the handle is smooth in texture, making it possible for the dumbbell to slip out of the hand during use and possibly cause an accident such as an injury to the user's foot or damage to the floor.

In order to solve the above problems, it is proposed herein an adjustable dumbbell.

SUMMARY

In order to solve the problems identified in the background section, i.e., a fixed length of the dumbbell's actuating handle that cannot be changed or adjusted according to actual needs, and the smoothness of the handle that makes it possible for the dumbbell to slip out of the hand during use and possibly cause an accident such as an injury to the user's foot or damage to the floor, the present utility model proposes an adjustable dumbbell with handles whose distances from respective rods can be changed to enable a length of the dumbbell to be adjusted and fixed. In addition, when held in a hand, the dumbbell allows greater friction with the palm and reduces the risk of slippage.

The invention provides the following technical proposals to realize the purpose:

An adjustable dumbbell, comprising knobs, bridge-shaped blocks, weight plates, a lift assembly, side plates, an anti-slip assembly and sleeves, wherein: the number of the weight plates is two, and they are fixedly attached to the opposing ends of the lift assembly; the bridge-shaped blocks and the weight plates are fixedly disposed between the lift assembly and the knobs;

the lift assembly comprises handles and a limit plate, the number of the handles being two, the handles having their end faces abutting against the limit plate, the handles (401) each defining an inner lumen through which a rod is inserted, the rod having one end welded and thus fixed to the limit plate and an outer surface in which locking grooves are formed, the locking grooves having inner surfaces slidably engaging locking blocks that are welded and thus fixed to an inner surface of the handle, the number of the locking blocks being plural, the multiple locking blocks being interposed with cushions fixedly arranged there between, the sleeves being disposed over the outer surfaces of the respective handles and welded and thus fixed to the limit plate, the sleeves each defining, in its outer surface, a slot having inner surfaces onto which a connecting plate is attached in a snap-on manner, the sleeve having inner surfaces on opposing sides of the slot, from which respective inserting plates project, the inserting plates having respective inner surfaces on which respective sockets are fixedly provided, the sockets being welded and thus fixed to the connecting plate, the handle and the rod being perforated in their outer surfaces with a first through hole and a second through hole, respectively, the first through hole and second through hole having respective interior surfaces on which a common securing bar is fixedly provided, the securing bar being welded and thus fixed to the connecting plate, the anti-slip assembly being fixedly attached to the outer surfaces of both the sleeves and the connecting plate by adhesion;

the anti-slip assembly includes granules and a soft mat adhered and hence fixed to outer surfaces of the granules.

As a further proposal of the invention, the locking blocks are tapered on both sides at their ends far away from the handle, with their outer surfaces fitting the inner surfaces of the respective locking grooves.

As a further proposal of the invention, the cushions are distributed in a circle over the outer surface of the rod, and the rod fits the handle.

As a further proposal of the invention, the first through hole is identical in size and corresponds in position to the second through hole.

As a further proposal of the invention, the second through hole penetrates through the rod on both side thereof and communicates with the first through hole.

As a further proposal of the invention, the connecting plate has a length that is less than that of the slot.

As a further proposal of the invention, a length of the securing bar is equal to a diameter of the handle.

The subject matter of the present utility model as defined above at least offers the beneficial effects as follows: concurrently with the separation of the sockets from the inserting plates as a result of pulling the connecting plate, the securing bar will be extracted from the second through hole and from the first through hole. The handle may then be pulled to a desired position by virtue of the movement of the locking blocks in the respective locking grooves. Subsequently, the securing bar may be again inserted into the first through hole and the second through hole, accomplishing the connection between the sleeve and the connecting plate. In this way, the user can adjust lengths of the handles according to its own needs. The granules may be made of an acetic silicone, while the soft mat may be made of a rubber. This can result in an effective increase in friction at the contact area with the user's palm, thereby enhancing the user's grip and lessening the risk of slippage and accident.

Figure 1:
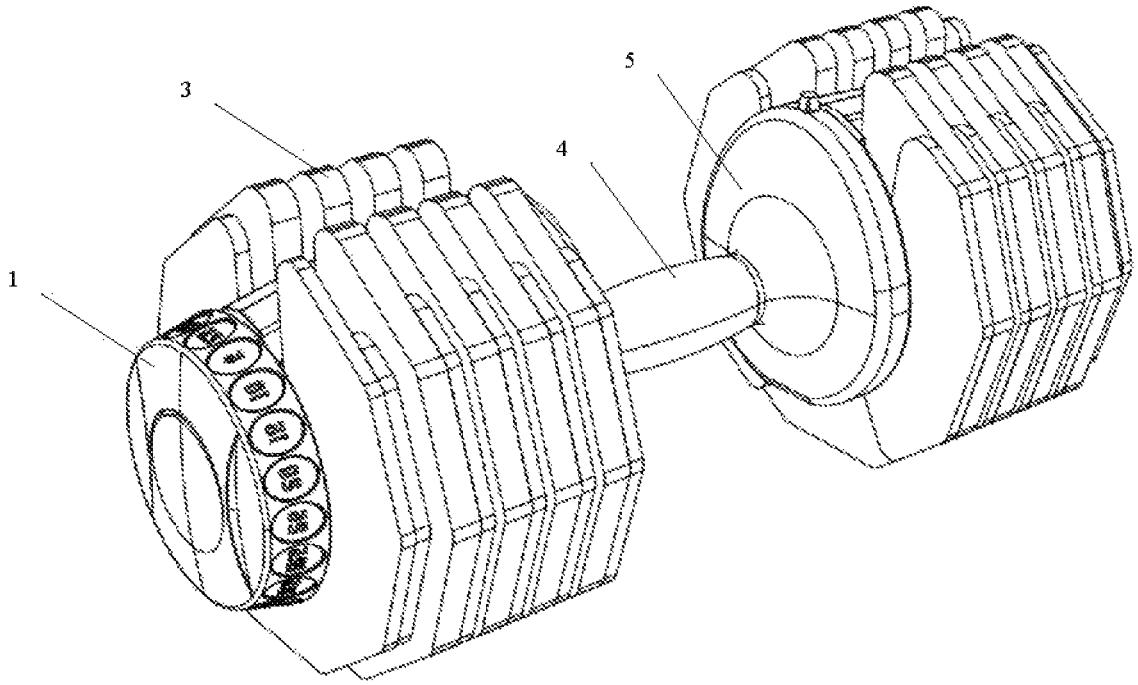
FIG. 1 illustrates the appearance of an adjustable dumbbell proposed in the present utility model.

In these figures,

1 denotes a knob; 2, a bridge-shaped block; 3, a weight plate; 4, a lift assembly; 401, a handle; 402, a limit plate; 5, a side plate; 6, an anti-slip assembly; 601, granules; 602, a soft mat; 7, a sleeve; 8, a slot; 9, a connecting plate; 10, a first through hole; 11, a locking grooves; 12, a locking block; 13, a cushion; 14, a rod; 15, a socket; 16, an inserting plate; 17, a second through hole; 18, a securing bar; and 20, a base.

DETAILED DESCRIPTION

In order for objects, features and advantages of the present utility model to be more apparent, the present utility model will be described in greater detail below in connection with specific embodiments and with reference to the accompanying drawings. It is to be understood that the description is presented merely for exemplification and is not meant to limit the scope of the utility model. In addition, in the following, descriptions of well-known structures and techniques are omitted so as not to unnecessarily obscure the concept of the present utility model.

As shown in FIGS. 1 to 10, an adjustable dumbbell proposed in the present utility model includes knobs 1, bridge-shaped blocks 2, weight plates 3, a lift assembly 4, side plates 5, an anti-slip assembly 6 and sleeves 7. The number of the weight plates 3 is two, and they are fixedly attached to the opposing ends of the lift assembly 4. The bridge-shaped blocks 2 and the weight plates 3 are fixedly disposed between the lift assembly 4 and the knobs 1.

The lift assembly 4 includes handles 401 and a limit plate 402. The number of the handles 401 is two, and their respective end faces abut against the limit plate 402. Each of the handles 401 defines an inner lumen through which a rod 14 is inserted. The rod 14 has one end welded and thus fixed to the limit plate 402 and an outer surface in which locking grooves 11 are formed. The locking grooves 11 have inner surfaces slidably engaging locking blocks 12 that are welded and thus fixed to an inner surface of the handle 401. The number of the locking blocks 12 is plural, and cushions 13 are fixedly arranged between them. The sleeves 7 are disposed over the outer surfaces of the respective handles 401 and are welded and thus fixed to the limit plate 402. Each of the sleeves 7 defines, in its outer surface, a slot 8 having inner surfaces onto which a connecting plate 9 is attached in a snap-on manner. The sleeve 7 has inner surfaces on opposing sides of the slot 8, from which respective inserting plates 16 project. The inserting plates 16 have respective inner surfaces on which respective sockets 15 are fixedly provided and are welded and thus fixed to the connecting plate 9. The handle 401 and the rod 14 are perforated in the it outer surfaces with a first through hole 10 and a second through hole 17, respectively. The first through hole 10 and the second through hole 17 have respective inner surfaces on which a common securing bar 18 is fixedly provided. The securing bar 18 is welded and thus fixed to the connecting plate 9. The anti-slip assembly 6 is fixedly attached to the outer surfaces of both the sleeves 7 and the connecting plate 9 by adhesion.

The anti-slip assembly 6 includes granules 601 and a soft mat 602 adhered and hence fixed to outer surfaces of the granules 601.

In this embodiment, the locking blocks 12 may be tapered on both sides at their ends far away from the handle 401, with their outer surfaces fitting the inner surfaces of the respective locking grooves 11.

In this utility model, pulling the connecting plate 9 will result in both the separation of the sockets 15 from the inserting plates 16 and extraction of the securing bar 18 from the second through hole 17 and the first through hole 10. The handle 401 may then be pulled to a desired position by virtue of the movement of the locking blocks 12 in the respective locking grooves 11. Subsequently, the securing bar 18 may be again inserted into the first through hole 10 and the second through hole 17, accomplishing the connection between the sleeve 7 and the connecting plate 9. In this way, the user can adjust lengths of the handles 401 according to its own needs. The granules 601 may be made or an acetic silicone, while the soft mat 602 may be made of a rubber. This can result in an effective increase in friction at the contact area with the user's palm, thereby enhancing the user's grip and lessening the risk of slippage and accident.

It is to be noted that, with the locking blocks 12 being tapered on both sides and fitting the respective locking grooves 11, it is ensured that the handle 401 can be moved with stability, thus enhancing the convenience of use.

Figure 4:
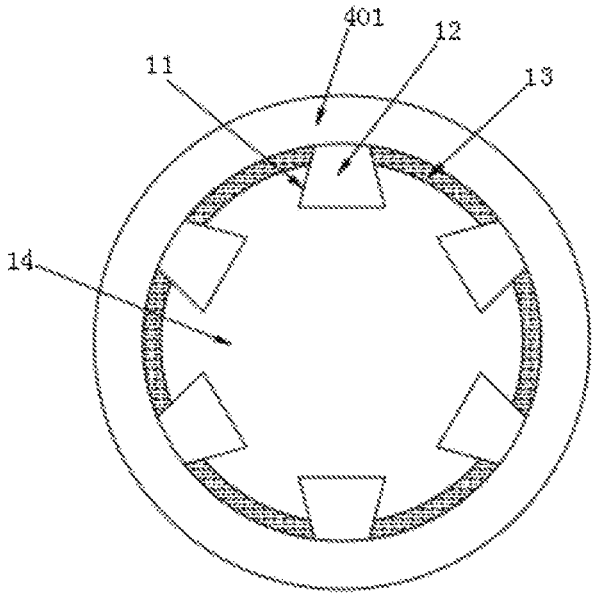
FIG. 4 is a structural schematic of a handle and a rod in an adjustable dumbbell proposed in the present utility model.

As shown in FIG. 4, the cushions 13 may be distributed in a circle on the outer surface or the rod 14, with the latter fitting the handle 401.

It is to be noted that the cushions 13 may fit the rod 14 with the handle 401 so that the handle 401 can be moved with higher stability and minimal likelihood of swaying, additionally enhancing the convenience of use.

Figure 5:
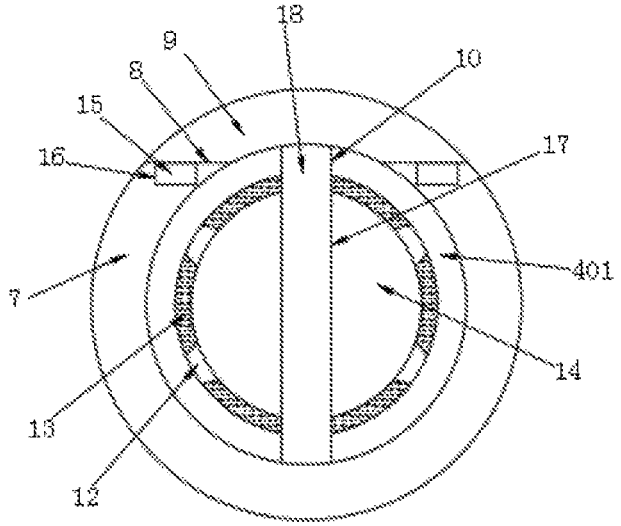
FIG. 5 is a structural schematic of a sleeve and a connecting plate in an adjustable dumbbell proposed in the present utility model.
Figure 6:
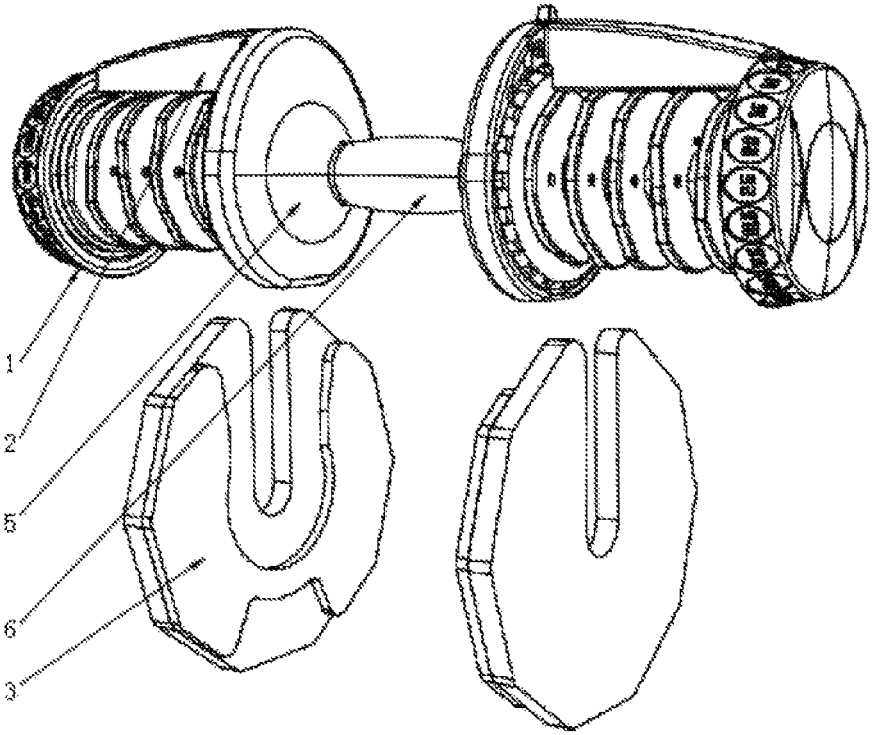
FIG. 6 is an exploded view of an adjustable dumbbell proposed in the present utility model.

As shown in FIG. 5, the first through hole 10 may be identical in size and correspond in position to the second through hole 17.

It is to be noted that the user can fix the handle 401 with respect to the rod 14 by connecting the securing bar 18 to both the first through hole 10 and the second through hole 17 so as to enhance the convenience of use.

As shown in FIG. 5, the second through hole 17 may penetrate through the rod 14 on both sides thereof and communicate with the first through hole 10.

It is to be noted that, with the second through hole 17 penetrating through the rod 14 on both sides thereof, when the securing bar 18 is connected to the first through hole 10 and the second through hole 17, a length between the handle 401 and the rod 14 can be effectively fixed.

Figure 2:
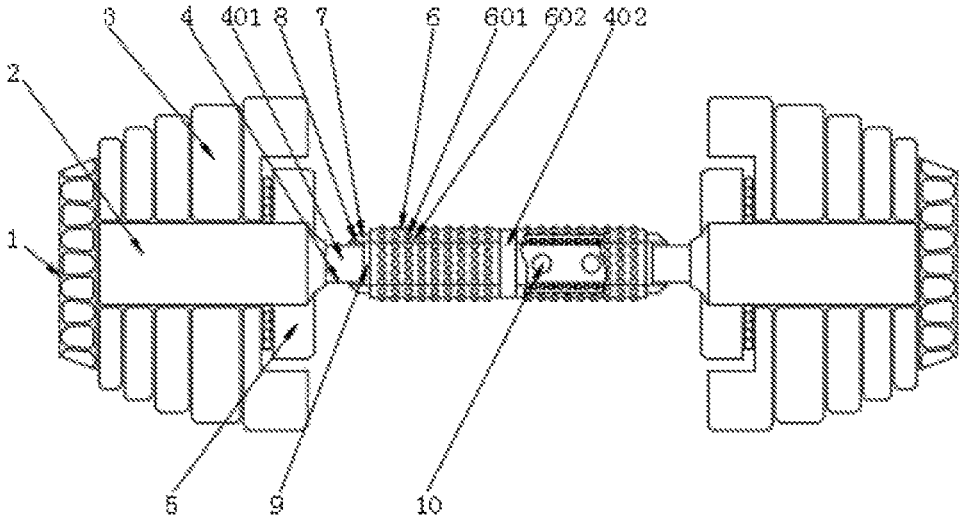
FIG. 2 is a structural schematic of an adjustable dumbbell proposed in the present utility model.
Figure 3:
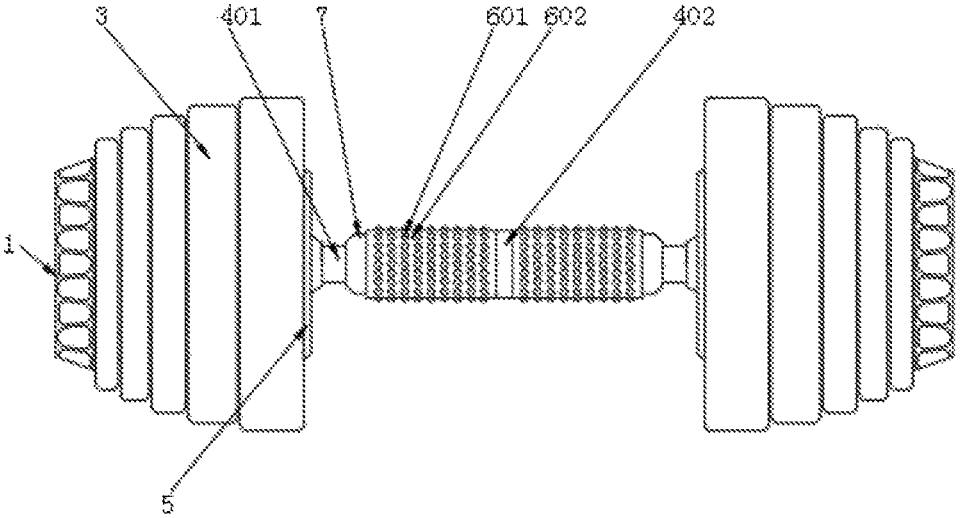
FIG. 3 is a schematic top view of an adjustable dumbbell proposed in the present utility model.

As shown in FIG. 2, the connecting plate 9 may have a length that is less than that of the slot 8.

It is to be noted that, with the length of the connecting plate 9 being less than that of the slot 8, the user can insert a finger into the slot 8 to separate the connecting plate 9 from the slot 8. This enables the user to easily adjust the length between the handle 401 and the rod 14.

As shown in FIG. 5, a length of the securing bar 18 may be equal to a diameter of the handle 401.

It is to be noted that, after the securing bar 18 is inserted in the second through hole 17 and the first through hole 10, the end of the securing bar 18 far away from the connecting plate 9 may abut against the sleeve 7, guaranteeing the fixation of the rod 14 and the handle 401 and enhancing the convenience of use.

Figure 7:
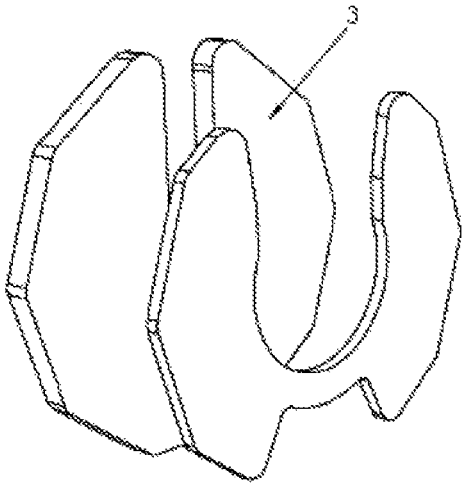
FIG. 7 is an exploded view of a weight plate in an adjustable dumbbell proposed in the present utility model.
Figure 8:
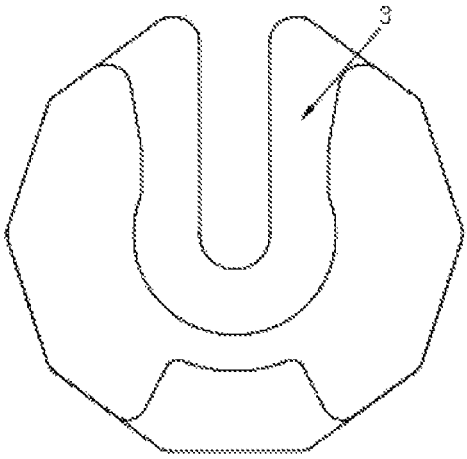
FIG. 8 is a structural schematic of a weight plate in an adjustable dumbbell proposed in the present utility model.
Figure 9:
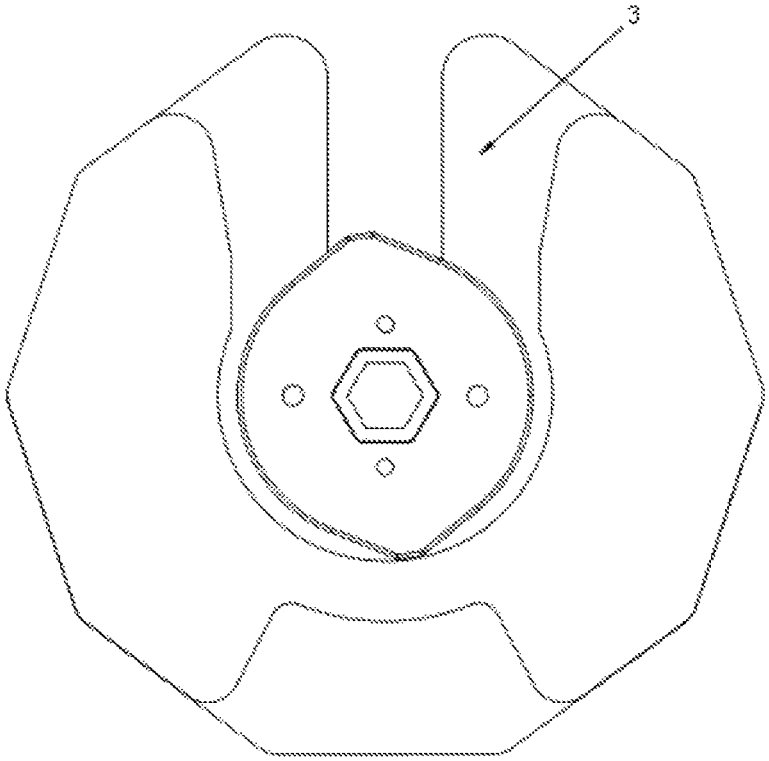
FIG. 9 is a cross-sectional view of a weight plate in an adjustable dumbbell proposed in the present utility model.
Figure 10:
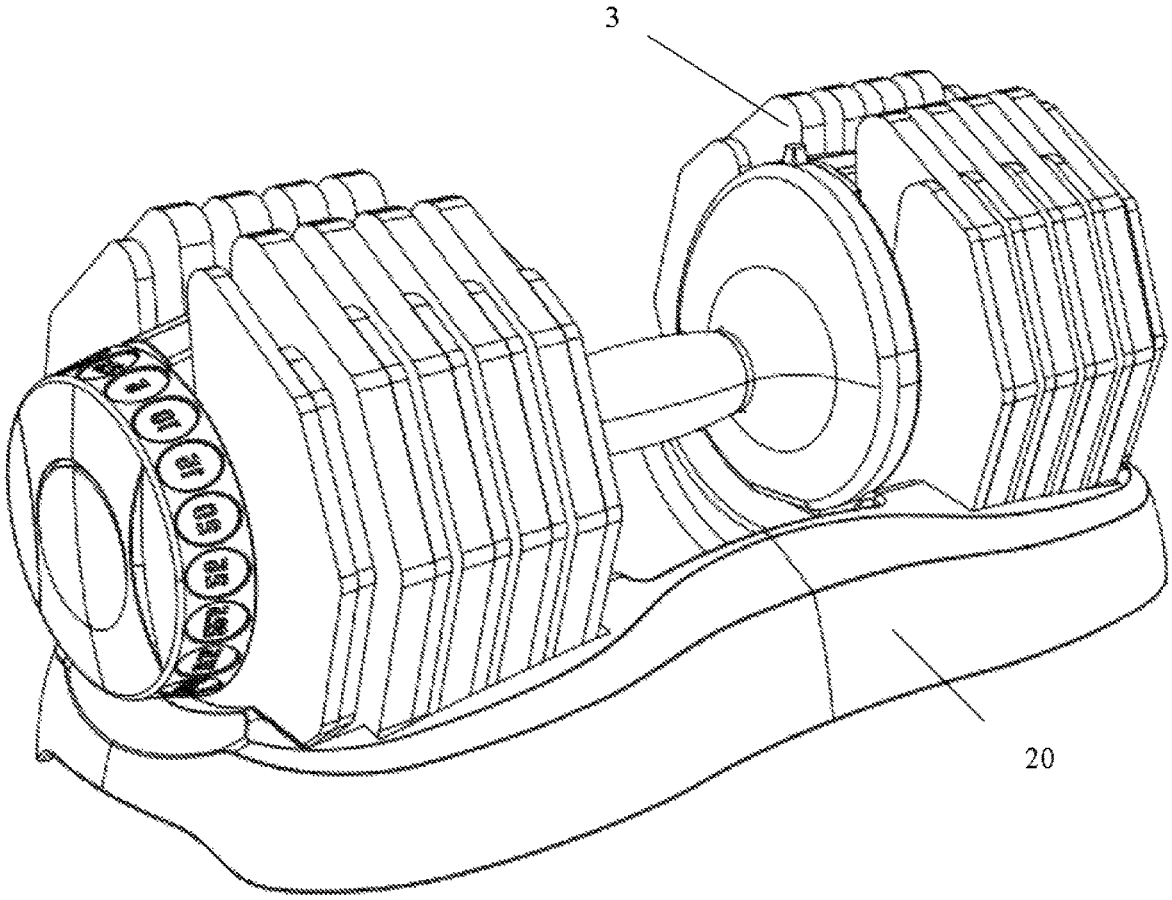
FIG. 10 schematically illustrates the placement of an adjustable dumbbell proposed in the present utility model.

Referring to FIGS. 7 to 9, the weight plates 3 may each include two portions of different sizes and shapes. However, preferably, the two portions are at least partially flush with each other at their outer edges so that they can be put together to allow easily weight adjustments while not compromising the appearance. Further, the portion having a smaller weight defines a cutout at its bottom edge so as not to be flush with the portion having a greater weight at the bottom edge. With combined reference to FIG. 10, the cutout allows the dumbbell to be placed in a base 20 which has a complementary protrusion. The dumbbell can be secured in the base 20 when the recess mates with the protrusion. Furthermore, the base may also have a depression in which the protrusion projects. In this way, the dumbbell can be prevented from rolling away to possibly cause an accident.

It is to be understood that the specific embodiments of the present utility model are set forth hereinabove merely to exemplify and explain the principles of the utility model rather than to limit the utility model. Thus, any modifications, equivalents, improvements and the like made without departing from the spirit and scope of the present utility model are meant to be within the scope of protection of the utility model. In addition, the claims appended hereto cover all changes and modifications as fall within the scope and limit, as well as equivalents thereof, of the appended claims.

I claim:

1. An adjustable dumbbell, comprising knobs (1), bridge-shaped blocks (2), weight plates (3), a lift assembly (4), side plates (5), an anti-slip assembly (6) and sleeves (7), wherein: a number of the weight plates (3) is two, and the weight plates are fixedly and respectively attached to opposing ends of the lift assembly (4); the bridge-shaped blocks (2) and the weight plates (3) are fixedly disposed between the lift assembly (4) and the knobs (1);

the lift assembly (4) comprises handles (401) and a limit plate (402), a number of the handles (401) being two, end faces of the handles (401) respectively abutting against the limit plate (402), the handles (401) each defining an inner lumen through which a rod (14) is inserted, the rod (14) having one end welded and thus fixed to the limit plate (402) and an outer surface in which locking grooves (11) are formed, the locking grooves (11) having inner surfaces slidably engaging locking blocks (12) that are welded and thus fixed to an inner surface of each respective handle (401), a number of the locking blocks being plural, the plural locking blocks (12) being interposed with cushions (13) fixedly arranged therebetween, the sleeves (7) being disposed over outer surfaces of the respective handles (401) and welded and thus fixed to the limit plate (402), the sleeves (7) each defining, in an outer surface thereof, a slot (8) having inner surfaces onto which a connecting plate (9) is attached in a snap-on manner, the sleeve having inner surfaces on opposing sides of the slot (8), from which respective inserting plates (16) project, the respective inserting plates (16) having respective inner surfaces on which respective sockets (15) are fixedly provided, the respective sockets (15) being welded and thus fixed to the respective connecting plate (9), each handle (401) and respective rod (14) being perforated in respective outer surfaces with a first through hole (10) and a second through hole (17), respectively, the first through hole (10) and the second through hole (17) having respective interior surfaces on which a common securing bar (18) is fixedly provided, the common securing bar (18) being welded and thus fixed to the respective connecting plate (9), the anti-slip assembly (6) being fixedly attached both to the outer surfaces of the respective sleeves (7) and an outer surface of the respective connecting plates (9) by adhesion;

the anti-slip assembly (6) includes granules (601) and a soft mat (602) adhered and hence fixed to outer surfaces of the granules (601).

2. The adjustable dumbbell according to claim 1, wherein the locking blocks (12) are tapered on two sides at ends of the locking blocks (12) located far away from the handles (401), respectively, with outer surfaces of the locking blocks fitting the inner surfaces of the respective locking grooves (11).

3. The adjustable dumbbell according to claim 1, wherein the cushions (13) are distributed in a circle over the outer surface of the rod (14), and the rod (14) fits the handles (401).

4. The adjustable dumbbell according to claim 1, wherein the first through hole (10) is identical in size and corresponds in position to the second through hole (17).

5. The adjustable dumbbell according to claim 1, wherein the second through hole (17) penetrates through the rod (14) on two sides thereof and communicates with the first through hole (10).

6. The adjustable dumbbell according to claim 1, wherein the connecting plate (9) has a length that is less than a length of the slot (8).

7. The adjustable dumbbell according to claim 1, wherein a length of the common securing bar (18) is equal to a diameter of the handles (401).

* * * * *